United States Patent [19]

Homolik

[11] Patent Number: 4,528,897

[45] Date of Patent: Jul. 16, 1985

[54] CHIMNEY CAP

[75] Inventor: Mathew W. Homolik, Provo, Utah

[73] Assignee: Energy Cap, Inc., Orem, Utah

[21] Appl. No.: 439,180

[22] Filed: Nov. 4, 1982

[51] Int. Cl.[3] ..... F23L 17/02

[52] U.S. Cl. ..... 98/59; 98/122; 49/357; 49/379; 16/289; 16/306

[58] Field of Search ..... 98/59, 122, 119; 49/386, 347, 379, 357; 16/277, 279, DIG. 7, 289, 290, 286, 306

[56] References Cited

U.S. PATENT DOCUMENTS

| | | | |
|---|---|---|---|
| 1,299,228 | 4/1919 | Ricketson | 110/173 R |
| 2,072,083 | 3/1937 | Cambell | 49/347 |
| 2,856,839 | 10/1958 | Soderberg | 98/59 |
| 3,112,514 | 12/1963 | Ostrom | 16/289 |
| 3,377,939 | 4/1968 | Sailors | 98/59 |
| 3,545,365 | 12/1970 | Snader | 98/59 |
| 3,945,307 | 3/1976 | Lyemance | 98/60 |
| 4,020,754 | 5/1977 | Dalsin et al. | 98/59 |
| 4,165,679 | 8/1979 | Lyemance | 98/59 |
| 4,181,119 | 1/1980 | Lyles | 126/286 |
| 4,256,257 | 3/1981 | Pinkerton | 236/1 G |
| 4,368,663 | 1/1983 | Tabacco | 98/59 |

*Primary Examiner*—William E. Wayner
*Assistant Examiner*—John M. Sollecito
*Attorney, Agent, or Firm*—Workman, Nydegger & Jensen

[57] ABSTRACT

The present invention provides a chimney flue cap for a fireplace which can easily be installed on the top of new or existing chimney flues. The cap comprises a generally planar sheet of metal designed to fit over the opening in the top of the flue. The cap is mounted to the flue by a hinge means formed from two plates. The first plate is mounted on the cap with a portion extending past an edge thereof. The extending portion is divided into three parts, the outer two of which are bent downward to form a portion of the hinge. The center flange is bent upward and is connected to a spring which urges the cap towards the open position. A second plate is mounted on the side of the flue and has three outwardly projecting tabs. Two tabs are connected to the downwardly depending flanges to form the hinge and the third tap serves as an anchor for the spring which opens the cap.

17 Claims, 2 Drawing Figures

CHIMNEY CAP

BACKGROUND

1. Field of the Invention

The present invention relates to damper mechanisms for chimneys and, more particularly, to a novel chimney cap designed to be positioned on top of the chimney flue.

2. The Prior Art

With the ever increasing cost of conventional sources of energy, more and more people are utilizing their fireplaces as an alternative or supplemental source for heating their homes. Additionally, people are becoming concerned with finding and implementing means for reducing heat losses from their homes. One of the major sources of heat loss is an undampered or only partially dampered chimney flue. Unless restrained, hot air rises through the flue and escapes from a home.

Many fireplaces have a damper located immediately above the firebox to prevent warm air from escaping up the chimney. However, these dampers are usually loose fitting and only partially eliminate the problem. This is especially true when the wind blows across the top of the chimney causing a siphoning effect. Additionally, these dampers do not eliminate other problems associated with chimneys such as rain, snow and leaves which fall down the flue and the entrance of small animals such as birds and squirrels or insects.

Various attempts have been made to develop a damper which can be placed on the top of a chimney flue to eliminate these problems. However, these devices have generally been complicated and difficult to install or have had complicated operating mechanisms making them unreliable.

Accordingly, it would be a significant advancement in the art to provide a chimney cap which can easily be installed on top of a chimney flue to prevent heat loss when the fireplace is not being used and which can prevent rain, snow, leaves and animals from entering the chimney. Such a device is disclosed and claimed herein.

BRIEF SUMMARY AND OBJECTS OF THE INVENTION

The present invention comprises a cap which is mounted on top of a chimney flue to prevent warm air from escaping when the fireplace is not being used. The cap basically comprises a flat sheet of metal having a lip depending downward from the periphery thereof. A resilient band is formed on the upper edge of the flue from silicone or other similar material to engage the bottom of the cap and form an air tight seal when the cap is in the closed position. A metal plate is fastened by a series of bolts to one of the outer sides of the flue and is connected to a second plate positioned on the cap to form a hinge means to secure the cap to the flue and to provide a means whereby the cap can be opened and closed. A spring is connected between a flange on the metal plate attached to the flue and a flange on the cap to urge the cap to an open position by pivoting it around the hinge.

A metal bracket is mounted to the underside of the chimney cap and a cable or similar means is connected thereto. This cable extends down the flue and terminates in the firebox. A bracket is mounted in the firebox onto which the cable is fastened in such a manner that the chimney cap can be adjusted between open and closed positions.

The chimney cap is closed by pulling on the cable until the cap firmly abuts the top of the chimney flue and then securing the cable to the bracket in the firebox to maintain the cap in the closed position. When the cable is released, the spring mounted to the cap urges it to the open position.

It is, therefore, a primary object of the present invention to provide a chimney cap which can easily be installed on the top of new or existing flues and which provides an air tight seal to prevent warm air from escaping up the chimney when the fireplace is not in use.

It is a further object of the present invention to provide a chimney cap which is simple but reliable in operation and which is generally urged toward the open position.

These and other objects and features of the present invention will become more fully apparent from the following description and appended claims taken in conjunction with the accompanying drawings.

DETAILED DESCRIPTION OF THE PREFERRED EMBODIMENT

The present invention relates to damper mechanisms for chimney flues and more particularly to a cap designed to be mounted to the top of the flue. The invention is best understood by reference to the accompanying drawings wherein like parts are designated with like numerals throughout.

Figure 1:
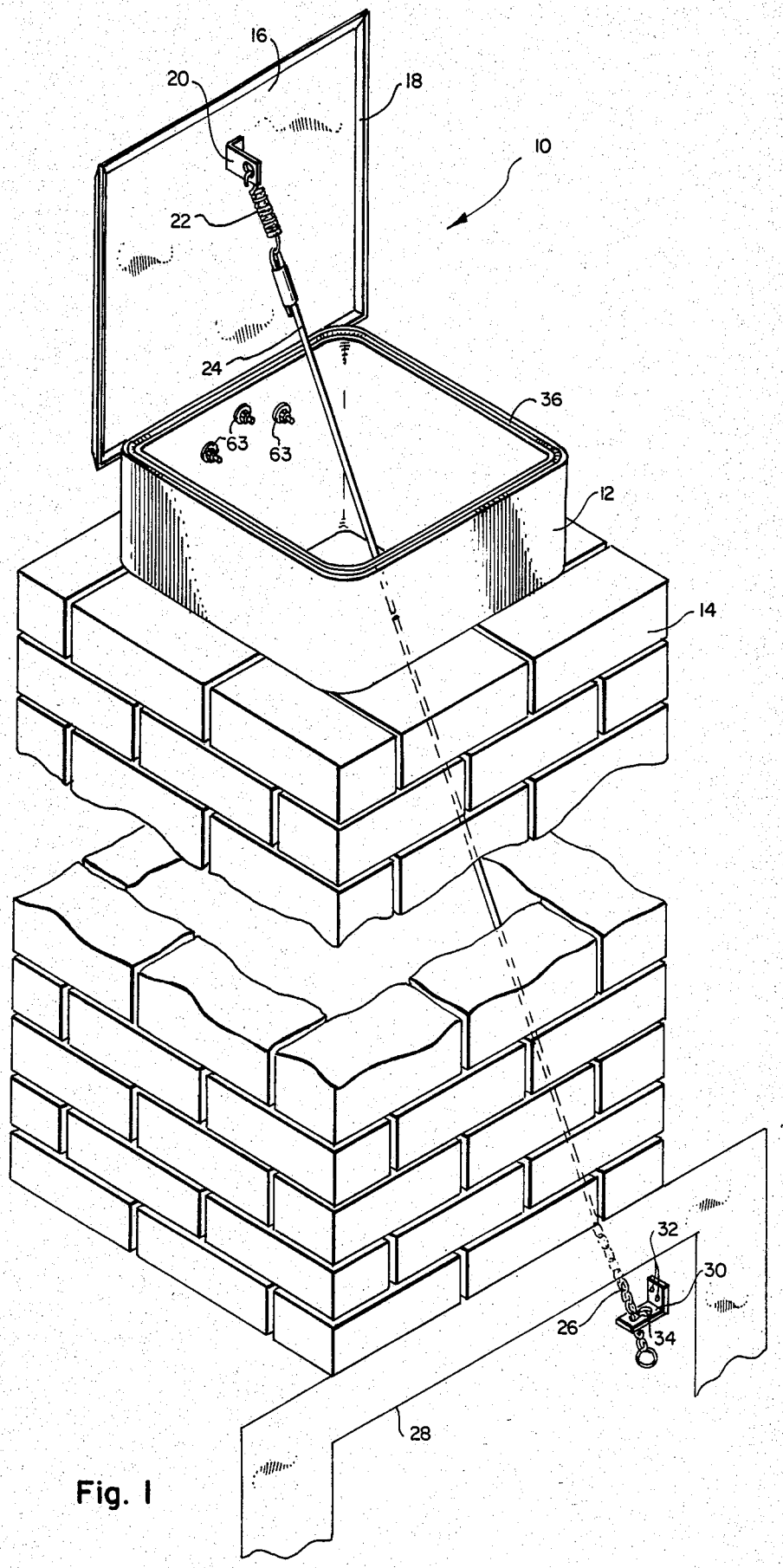
FIG. 1 is a perspective illustration of a chimney flue with the chimney cap of the present invention mounted to the top thereof and with the fastening bracket mounted to the inside of the firebox.

In FIG. 1, the chimney cap assembly of the present invention is generally designated 10 and is mounted to flue 12 of chimney 14 by a hinge assembly which will be described more fully hereinafter. Assembly 10 basically comprises a cap 16 which is sized to cover the opening on top of flue 12 and to extend slightly beyond the sides of flue 12 to provide a means for forming an essentially air tight seal. Cap 16 has a downwardly projecting lip 18 around the periphery thereof which is designed to shield the area between cap 16 and the top of flue 12 from rain and snow when the cap is in the closed position. If ice were to form between cap 16 and flue 12 it would make it difficult if not impossible to open cap 16.

A resilient band 36 is formed on the top of flue 12 to insure an essentially air-tight seal between cap 16 and flue 12 when cap 16 is in the closed position. Band 36 is formed from silicone or other similar material which is resistant to the heat and smoke exiting from the top of flue 12. In practice, band 12 can be formed from any one of a number of commercially available silicone caulkings which are packaged in a tube. Thus, a homeowner can easily form band 36 himself while installing assembly 10.

An L-shaped bracket 20 is mounted to the underside of cap 16 to provide a means for closing the chimney cap. A spring 22 is connected to bracket 20 on one end thereof and the other end is connected to cable 24. Cable 24 extends down through flue 12 of chimney 14 and terminates in a chain 26 positioned within firebox 28.

A second L-shaped bracket 30 is mounted to the interior of firebox 28 with screws 32. Chain 26 passes through a keyhole shaped opening 34 in bracket 30.

Chain 26 passes through opening 34 in bracket 30 to serve as a locking means for the chimney cap. Chain 26 is sized such that it will easily pass through the larger circular portion of opening 34 but not through the narrower slot portion. Accordingly, by positioning one of the links of chain 26 longitudinally within the slot portion of opening 34, the chimney cap can be retained in the closed position or in any one of a number of partially opened positions.

While spring 22 has been illustrated in the preferred embodiment as being located between bracket 20 and cable 24, it will be readily appreciated by those skilled in the art that spring 22 could be located anywhere within the length of cable 24 or even between cable 24 and chain 26. The purpose of spring 22 is to provide biasing means to securely hold plate 16 against flue 12 in the closed position and to allow chain 26 to be extended so that it can be positioned in the locked position in bracket 30.

Figure 2:
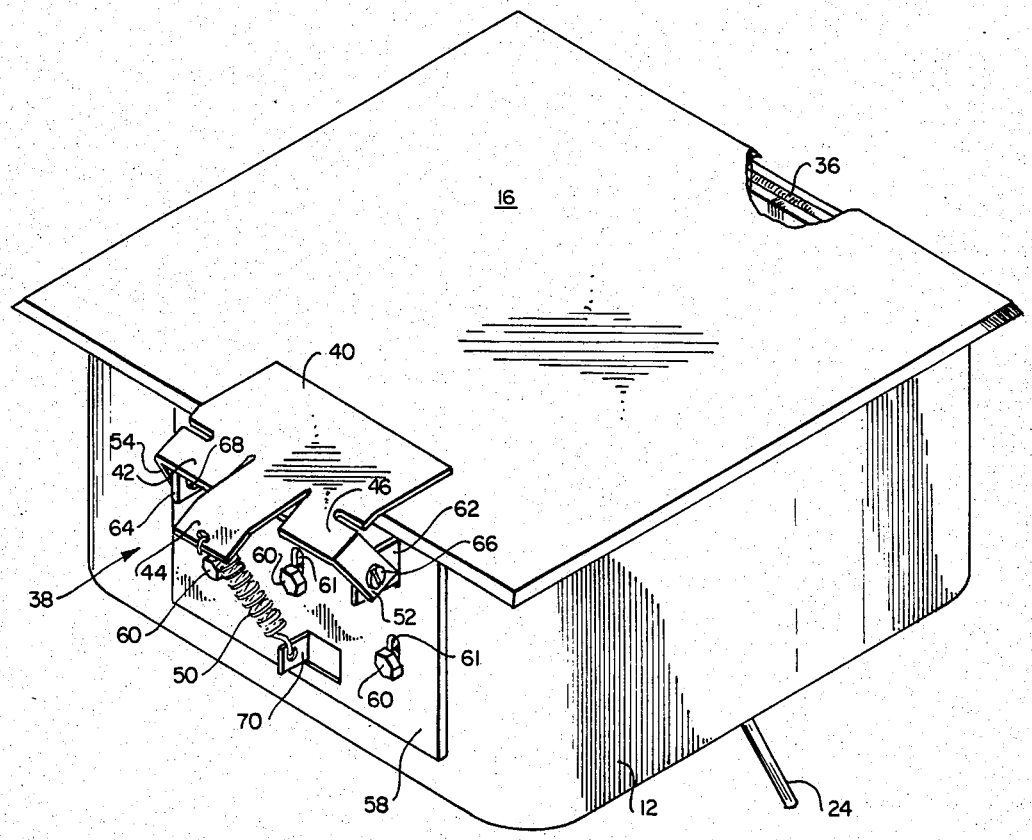
FIG. 2 is a rear perspective view of the chimney cap of the present invention illustrating the mounting plate and hinge means connected to the cap.

Referring now to FIG. 2, the mounting means of chimney cap assembly 10 is illustrated in greater detail.

A small plate 40 is attached to the top surface of cap 16 such that approximately half of plate 40 is above cap 16 and approximately half of plate 40 extends past the edge thereof. The outward extending portion is divided into three flanges 42, 44, and 46. Outer flanges 42 and 46 are bent slightly downward to form a portion of the hinge means (discussed in greater detail hereinafter) which secures cap 16 to flue 12. Center flange 44 is bent slightly upwardly and is connected to spring 50 which urges cap 16 towards the open position. The chimney cap assembly of the present invention is designed such that spring 22 forces the cap to the open and not the closed position to protect against problems which could occur should cable 24 break or become disengaged while a fire is burning in the fireplace.

The outer portion of flanges 42 and 46 are bent inwardly to form downwardly depending tabs 52 and 54. The perpendicular axis passing through the centers of tabs 52 and 54 defines the pivot point about which hinge assembly 38 rotates.

The other portion of hinge assembly 38 comprises plate 58 which is fastened to flue 12 by bolts 60 which pass through vertical slots 61 formed in plate 58. Slots 61 allow plate 58 to be adjusted once it is fastened to flue 12.

Plate 58 has outwardly projecting tabs 62 and 64 which are positioned adjacent tabs 52 and 54. Bolt 66 passes through tabs 52 and 62 and bolt 68 passes through tabs 54 and 64 along the access of rotation of hinge assembly 38.

Inasmuch as one of the principal objects of the present invention is to provide a chimney cap which can easily be installed by the do-it-yourself homeowner, plate 58 is designed to be mounted without special tools. All that is needed is a drill to create the holes through which bolts 60 are inserted. Washers 63 (see FIG. 1) are placed on bolts 60 inside flue 12 to prevent the bolts from being pulled back through the holes.

Referring again to FIG. 2, a third tab 70 is formed in plate 58 onto which the other end of spring 50 is fastened. Thus, when the tension on cable 24 is released, spring 50 operating between flange 44 and tab 70 urges cap 16 into the upright and opened position.

In operation, cap 16 is opened at the time a fire is built in firebox 28 and is left open as long as the fire is burning. When the fire is fully extinguished, cap 16 is closed by pulling on cable 24 to seal the upper end of flue 12 and prevent warm air from escaping from the home and to prevent small animals and objects from entering the chimney flue.

It will be readily appreciated by those skilled in the art that the present invention provides a novel chimney cap which is simple to operate and to install yet securely seals the top of the chimney flue when the cap is in the closed position.

It will also be reaily appreciated that the invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All modifications or changes which come within the meaning and range of equivalency of the claims are to be embraced within their scope.

What is claimed and desired to be secured by United States Letters Patent is:

1. A chimney flue cap for a fireplace comprising:

a cover means configured so as to cover an upper opening of a chimney flue;

hinge means located exterior to the chimney flue for mounting said cover means to the chimney flue, said hinge means comprising:

a first plate member mounted to the outside surface of said cover means, said first plate member having three flanges extending beyond the peripheral edge of said cover means, two of said flanges being bent downwardly and one of said flanges being bent upwardly;

a second plate member capable of being securely fastened to the outside surface of the chimney flue adjacent the first plate member, said second plate member having two upper tab members and one lower tab member bent outwardly therefrom, each of said upper tab members being hingeably mounted to a corresponding downwardly bent flange of said first plate member;

fastening means for connecting each upper tab member of the second plate member to its corresponding downwardly bent flange of the first plate member, said fastening means defining an axis of rotation for said hinge means; and spring means connecting said lower tab member to said upwardly bent flange, said spring means urging said cover means to an open position;

cable means connected to said cover means in such a manner as to urge said cover means to a closed position, said cable means extending through said flue and into said fireplace; and bracket means mounted in said fireplace for securing said cable means.

2. A chimney flue cap for a fireplace as defined in claim 1 wherein said cover means is generally planar and is fashioned of rigid metal.

3. A chimney flue cap for a fireplace as defined in claim 2 wherein said cover means has a downwardly depending lip at the peripheral edge thereof.

4. A chimney flue cap for a fireplace as defined in claim 1 wherein said bracket means comprises an L-shaped bracket having a keyhole-shaped opening therein.

5. A chimney flue cap for a fireplace as defined in claim 4 wherein a cable means comprises a chain for at least a lower portion thereof, said chain being capable of passing through a circular portion of said keyhole-shaped opening but being restrained when inserted in a slotted portion of said keyhole-shaped opening.

6. A chimney flue cap for a fireplace as defined in claim 1 wherein said upwardly bent flange is positioned between the two downwardly bent flanges.

7. A chimney flue cap for a fireplace comprising:

a cover means configured so as to cover an upper opening of a chimney flue;

hinge means located exterior to the chimney flue for mounting said cover means to the chimney flue, said hinge means comprising:

a first plate member fastened to the outside surface of said cover means, said first plate member having a first portion overlapping said cover means and having a second portion extending beyond a peripheral edge of said cover means, said second portion having three flanges, two of said flanges being bent downwardly and one of said flanges being bent upwardly;

a second plate member capable of being securely fastened to the outside surface of the chimney flue adjacent the first plate member, said second plate member having two upper tab members and one lower tab member bent outwardly therefrom, each of said upper tab members being hingeably mounted to a corresponding downwardly bent flange of said first plate member;

fastening means for connecting each upper tab member of the second plate member to its corresponding downwardly bent flange of the first plate member, said fastening means defining an axis of rotation for said hinge means; and spring means connecting said lower tab member to said upwardly bent flange, said spring means urging said cover means to an open position;

cable means connected to said cover means in such a manner as to urge said cover means to a closed position, said cable means extending through said flue and into said fireplace; and bracket means mounted in said fireplace for securing said cable means.

8. A chimney flue cap for a fireplace as defined in claim 7 wherein said cover means is generally planar and is fashioned of rigid metal.

9. A chimney flue cap for a fireplace as defined in claim 8 wherein said cover means has a downwardly depending lip at the peripheral edge thereof.

10. A chimney flue cap for a fireplace as defined in claim 7 wherein said bracket means comprises an L-shaped bracket having a keyhole-shaped opening therein.

11. A chimney flue cap for a fireplace as defined in claim 10 wherein said cable means comprises a chain for at least a lower portion thereof, said chain being capable of passing through a circular portion of said keyhole-shaped opening but being restrained when inserted in a slotted portion of said keyhole-shaped opening.

12. A chimney flue cap for a fireplace as defined in claim 7 wherein said upwardly bent flange is positioned between the two downwardly bent flanges.

13. A chimney flue cap for a fireplace comprising:

a cap means sized to cover an upper opening of a chimney flue;

a hinge means located exterior to the chimney flue for mounting said cap means to said chimney flue, said hinge means comprising:

a first plate member fastened to the outside surface of said cap means, said first plate member having a first portion overlapping said cap means and having a second portion extending beyond a peripheral edge of said cap means, said second portion being divided into a middle flange and two side flanges, said side flanges being bent downwardly and said middle flange being bent upwardly;

a second plate member capable of being securely fastened to the outside surface of said flue adjacent and below said first plate member, said second plate member having two upper tab members and one lower tab member bent outwardly therefrom, each of said upper tab members being hingeably mounted to a corresponding side flange of said first plate member;

fastening means for connecting each upper tab member to its corresponding side flange, said fastening means defining an axis of rotation for said hinge means; and spring means connecting said lower tab member to said middle flange, said spring means urging said cover to an open position;

cable means connected to said cap means in such a manner as to urge said cap means to a closed position, said cable means extending through said flue and into said fireplace; and bracket means mounted in said fireplace for securing said cable means.

14. A chimney flue cap for a fireplace as defined in claim 13 wherein said cover means is generally planar and is fashioned of rigid metal.

15. A chimney flue cap for a fireplace as defined in claim 14 wherein said cover means further has a downwardly depending lip at the perpheral edge thereof.

16. A chimney flue cap for a fireplace as defined in claim 15 wherein said bracket means comprises an L-shaped bracket having a keyhole-shaped opening therein.

17. A chimney flue cap for a fireplace as defined in claim 16 wherein said cable means comprises a chain for at least a lower portion thereof, said chain being capable of passing through a circular portion of said keyhole-shaped opening but being restrained when inserted in a slotted portion of said keyhole-shaped opening.

* * * * *